US005404306A

United States Patent [19]

Mathur et al.

[11] Patent Number: 5,404,306

[45] Date of Patent: Apr. 4, 1995

[54] VEHICULAR TRAFFIC MONITORING SYSTEM

[75] Inventors: Bimal P. Mathur, Thousand Oaks; David L. Standley, Westlake Village; Craig C. Reinhart, Moorpark; Shih-Chii Liu, Pasadena, all of Calif.; H. Taichi Wang, Hsinchu, Taiwan, Prov. of China

[73] Assignee: Rockwell International Corporation, Seal Beach, Calif.

[21] Appl. No.: 230,190

[22] Filed: Apr. 20, 1994

[51] Int. Cl.[6] ..... G08G 1/04; G08G 1/065

[52] U.S. Cl. ..... 364/436; 364/438; 348/149; 382/16

[58] Field of Search ..... 364/436, 437, 438; 348/149; 340/917; 382/16, 17, 23, 35

[56] References Cited

U.S. PATENT DOCUMENTS

| | | | |
|---|---|---|---|
| 4,847,772 | 7/1989 | Michalopoulos et al. | 364/436 |
| 4,970,653 | 11/1990 | Kenue | 364/461 |
| 5,062,000 | 10/1991 | Harris et al. | 358/213.27 |
| 5,161,107 | 11/1992 | Mayeaux et al. | 364/436 |
| 5,218,440 | 6/1993 | Mathur | 358/213.27 |
| 5,296,852 | 3/1994 | Rathi | 340/933 |
| 5,313,295 | 5/1994 | Taniguchi et al. | 348/149 |
| 5,317,311 | 5/1994 | Martell et al. | 340/905 |
| 5,351,044 | 9/1994 | Mathur et al. | 340/901 |

OTHER PUBLICATIONS

Harris et al., "Discarding Outliers Using a Nonlinear Resistive Network," *IEEE International Joint Conference on Neural Networks*, pp. I-501-06, Jul. 8, 1991.

*Primary Examiner*—Michael Zanelli
*Attorney, Agent, or Firm*—John C. McFarren

[57] ABSTRACT

A vehicular traffic monitoring system incorporates an array of photosensors and a nonlinear resistive network for identifying, locating, and processing outliers in sensor images of a highway or intersection. The camera system can be mounted on a pole or overpass to provide an image of the roadway or intersection. Areas of the outlier network ("video loops") are designated to correspond to selected areas of the roadway. Images are received by the outlier detection network with all data path switches closed between sensor elements and their corresponding network nodes. The system detects the presence of objects in the image by comparing the brightness or intensity of each pixel with that of the background. If the intensity of a pixel is significantly different from the background level, the data path switch corresponding to that pixel is opened. A readout of the state of all the switches in the network yields a map of outlier points for each video frame. The outlier map is connected to a data processing system to identify and locate outlier points in the image. The detection of a threshold number of outliers in a video loop indicates the presence of a vehicle at the corresponding area of the roadway. The processor, having a greatly reduced computational load without extensive image processing, simply measures and transmits traffic data such as the number and speed of vehicles passing through the video loops.

16 Claims, 3 Drawing Sheets

VEHICULAR TRAFFIC MONITORING SYSTEM

TECHNICAL FIELD

The present invention relates to systems for monitoring and controlling vehicular traffic and, in particular, to a visual system for monitoring traffic by detecting and processing points having significant contrast in a visual image.

BACKGROUND OF THE INVENTION

Information regarding vehicular traffic along highways and at intersections is useful for controlling the flow of traffic, especially during periods of congestion. Present methods of monitoring traffic include, for example, camera-based visual systems and inductive loops buried below the road surface. However, the number of locations that can be monitored in a highway network is limited by the cost and reliability of the monitoring systems. Inductive loops, as an example, are expensive to install, are not always reliable, and must be dug up to be repaired or replaced. Currently used visual systems are expensive because of the large amount of visual data that must be processed digitally for image recognition. Traffic monitoring networks could be made much denser, and thus more effective, if the cost and complexity of reliable monitoring systems could be reduced.

Images collected by sensors, such as imaging focal plane arrays (FPAs), for example, generally contain some points or pixels (which are referred to as "outliers") that are significantly different in brightness or intensity from their surrounding pixels. These points may be the result of glint, for example, or missing data points. Depending on the overall function of the sensor system, outliers may be interest points, such as those produced in the detection of point targets, or noise points, such as those produced by specular reflection from rain drops in laser radar images. A method and apparatus for isolating outliers in visual images is described by Harris et al., "Discarding Outliers Using a Nonlinear Resistive Network," *IEEE International Joint Conference on Neural Networks*, pp. I-501-506, Jul. 8, 1991.

SUMMARY OF THE INVENTION

An embodiment of the present vehicular traffic monitoring system comprises a camera system having an array of photosensors and a nonlinear resistive network for identifying, locating, and processing outliers in the sensor images of a highway or intersection. The compact camera system can be mounted on an existing traffic signal support or highway overpass, for example, to provide an image of the roadway or intersection. In the process of generating images, areas of the outlier network (which may be referred to a "video loops," "search windows," or "traps," for example) are designated to correspond to regions or sections of the roadway that have been selected for traffic monitoring. During operation of the outlier detection system, images are received with all the data switches in a closed (i.e., conducting) state between individual photosensor elements and their respective network nodes. The system detects objects and changes in the image by comparing the brightness or intensity of each pixel with that of the background. If the data at a given pixel (i.e., the brightness or intensity) is significantly different from the background level of neighboring pixels (i.e., the absolute value of the difference in brightness or intensity exceeds a predetermined threshold), the data path switch for that pixel is opened. A readout of the state of all the data path switches in the network yields a map of outlier points for each image frame.

The outlier map from the network is fed directly into an electronic data processing system to identify and locate significant points (outliers) in the image. The detection of a threshold number of outliers in a video loop indicates the presence of a vehicle at the corresponding area of the roadway. Without resorting to extensive image processing, the processor simply identifies and transmits traffic data such as the number and speed of vehicles passing through the video loops in the camera's field of view. Compared with prior art vision-based image recognition systems, the present invention greatly reduces the computational load on its data processor by using outliers to identify and process traffic information.

An object of the invention is an improved method of monitoring vehicular traffic. A feature of the invention is an outlier detection system that identifies points in an image that have significantly different brightness or intensity compared with the background. An advantage of the invention is a visual system that processes outliers in images to identify vehicles and generate traffic data simply and inexpensively.

BRIEF DESCRIPTION OF THE DRAWINGS

For a more complete understanding of the present invention and for further advantages thereof, the following Detailed Description of the Preferred Embodiments makes reference to the accompanying Drawings, in which like reference numerals refer to the same or similar elements throughout the several Figures, wherein.

DETAILED DESCRIPTION OF THE PREFERRED EMBODIMENTS

Figure 1A:
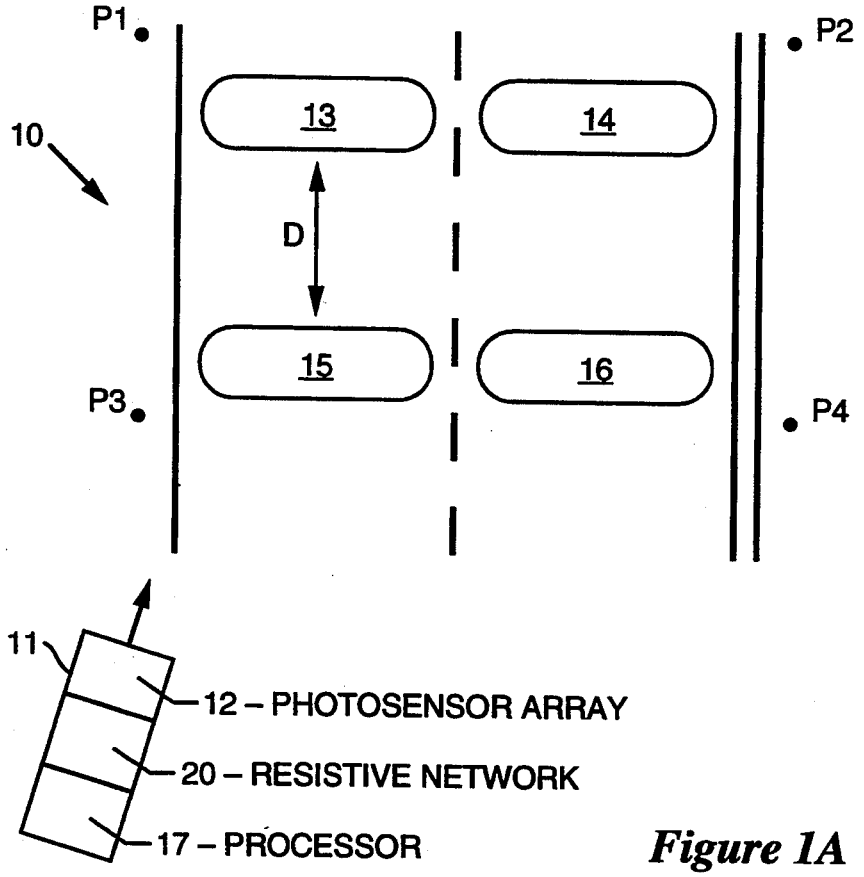
FIG. 1A is a plan view of a roadway section monitored by a system of the present invention.

An embodiment of the vehicular traffic monitoring system of the present invention comprises a camera system having an array of photosensors connected to a nonlinear resistive network for identifying, locating, and processing outliers in the sensor images of a highway or intersection. A plan view of a road or highway segment 10 monitored by the present invention is illustrated in FIG. 1A. A compact camera system 11, which includes a photosensor array 12, an outlier detection network 20, and an electronic data processing system 17, can be mounted on an existing traffic signal support or highway overpass, for example, to provide an image of a segment or intersection of road 10. Selected areas 13–16 of road 10 are designated for analyzing the presence and movement of vehicular traffic. Areas 13–16, which are designated but generally unmarked areas of road 10, may correspond to traditional inductance loops buried in the roadway at intersections, for example. Reference points P1–P4 may be designated at various locations around road segment 10 to facilitate aligning the field of view of camera system 11.

Figure 1B:
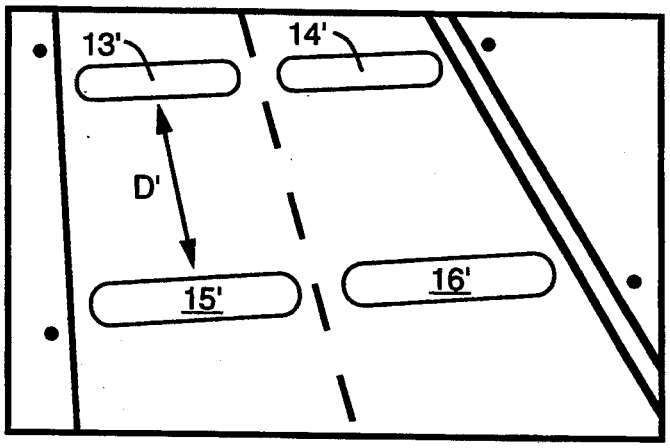
FIG. 1B is an image of the roadway section of FIG. 1A as viewed by a monitoring system of the present invention.

FIG. 1B represents a video image of road 10 generated by the photosensors 12 and outlier network 20 of camera system 11. Areas 13'–16' of the video image correspond to areas of outlier network 20 that are designated as "video loops," "search windows," or "traps," which in turn correspond to the designated areas or regions 13–16 of road 10. Video loops 13'–16' provide the basis for monitoring traffic on road 10. Camera system 11 examines video loops 13'–16' periodically at an established video frame rate to identify significant changes in the features of the image in video loops 13'–16'. Whereas a conventional buried inductance loop detects changes in the magnetic field above the inductance loop, system 11 detects changes in the number of outlier points in video loops 13'–16' of the sensor image. Detection of an increase in outlier points exceeding a threshold value over the background level in a video loop indicates the presence of a vehicle at the corresponding location on road 10. Vehicle velocity can be computed, for example, by noting the time between detection of outliers at loops 13' and 15' which are separated by a distance D' that corresponds to the actual distance D between areas 13 and 15 on road 10. The correspondence between distance D and distance D' is known based on the known mounting parameters of camera system 11 (i.e., height, azimuth, distance, etc.)

Operation of the Outlier Network

Figure 2A:
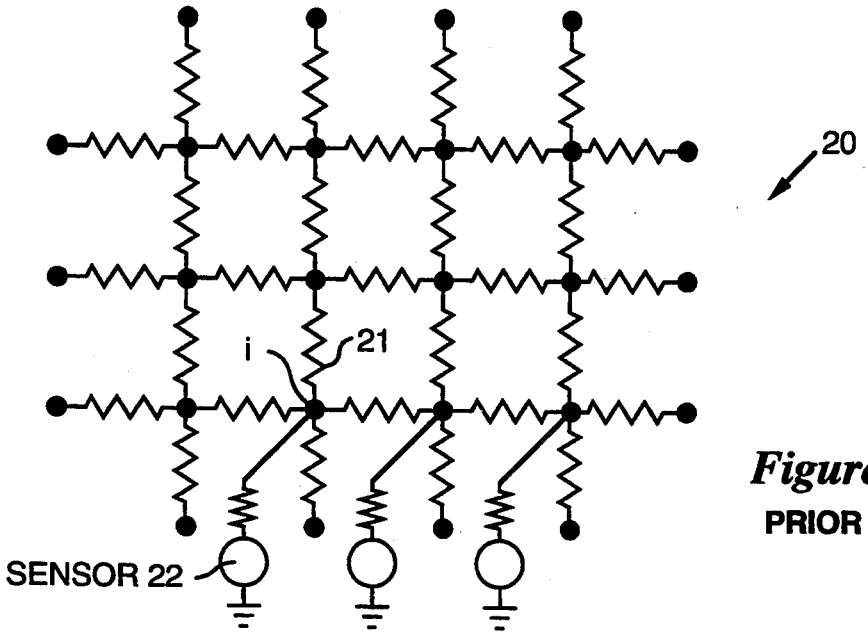
Figure 2A PRIOR ART
FIG. 2A is a schematic diagram of a prior art resistive network for smoothing images obtained from visual sensors.
Figure 2B:
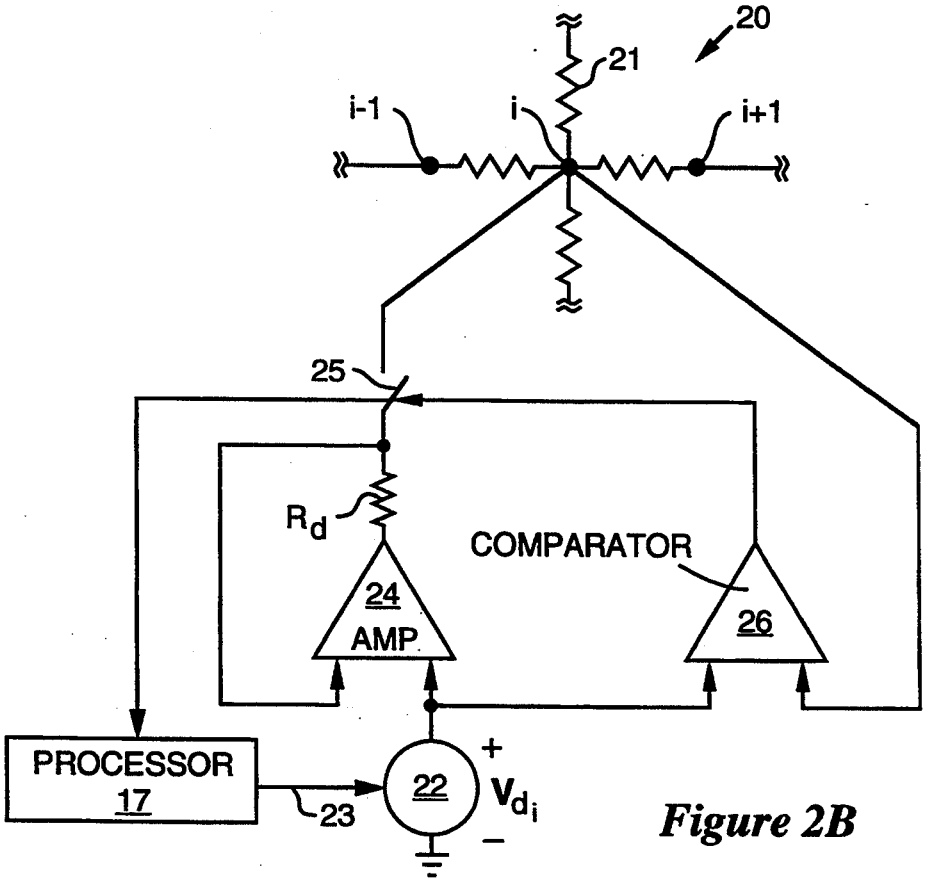
FIG. 2B is a schematic diagram of a nonlinear resistive network that incorporates a switch in each sensor data path to identify and locate outliers in sensor images.

Illustrative embodiments of an outlier detection network 20 are shown in FIGS. 2A and 2B. Network 20 is an electronic system for processing data collected from man-made sensors that produce images with point targets, missing data points, discontinuities, and/or noise such as glint. Network 20 comprises a resistive network for identifying, isolating, and/or rejecting points (outliers) in a sensor image that are substantially different from neighboring points. Network 20 may be implemented, in conjunction with photosensor array 12, as an integrated circuit on a semiconductor chip.

FIG. 2A is a schematic diagram of a typical (prior art) image plane resistive network 20 used for smoothing sensor images. Network 20 includes a plurality of nodes or pixels, such as node i, that form an image plane grid. Each node i is connected to neighboring nodes of the image plane grid through resistive elements such as resistor 21. Photosensor array 12 comprises a plurality of photodetectors, such as sensor element 22, each of which is connected to a corresponding node i of the image plane grid.

Referring to FIG. 2B, the input $Vdi$ of each photosensor element 22 is connected along a data path, which may include a resistive element $R_d$, to a corresponding node i of network 20. Outlier network 20 includes a resistive image plane grid, as shown in FIG. 2A, as well as a transconductance amplifier 24, a switch 25, and an absolute difference comparator 26 connected in the data path between each node i and its corresponding input $V_{di}$ from its sensor element 22. During operation of outlier network 20, images are received with all the data path switches 25 between the sensor elements 22 and their respective network nodes i in a closed (i.e., conducting) state. The system detects the presence of objects in the image by comparing the brightness or intensity of each pixel i with that of the background. If the data at a given pixel i (i.e., the brightness or intensity) is significantly different from the background level of its neighboring pixels (i.e., the absolute value of the difference in brightness or intensity exceeds a predetermined threshold), its switch 25 is opened. As illustrated in FIG. 2B, transconductance amplifier 24 and switch 25 connected between sensor 22 and node i form a nonlinear resistive element in the data path. Connected in series, transconductance amplifier 24 and switch 25 have a nonlinear, sigmoid-like I-V characteristic bounded by the operation of switch 25.

The operation of switch 25, as described above, may be controlled by an absolute difference comparator 26. Initially, all switches are closed and network 20 smoothes the input data values front all the sensor elements. Comparator 26 computes the absolute difference between the input data value $V_{di}$ and the smoothed data value at node i. If the absolute difference is greater than a threshold value, then the data value at node i is an outlier and switch 25 is opened. The position of an outlier, which is important in detecting vehicles and computing velocity, is indicated by the position of an open switch, such as switch 25 corresponding to node i, in network 20. A readout of the state of all the switches in network 20 yields a map of outlier point sources for each video image frame.

Traffic Monitoring

The outlier map from network 20 is connected directly to processor 17 (as shown in FIG. 2B) to identify and locate significant points in the image. The detection of a threshold number of outliers in a video loop indicates the presence of a vehicle at the corresponding area of the road 10. Thus, without resorting to extensive processing for image recognition, processor 17 simply measures and transmits traffic data such as the number and speed of vehicles passing through video loops 13'–16' based on the detection of outliers. The traffic data generated by cantera system 11 may be used to control traffic signals at intersections, for example. Compared with prior art vision-based systems, the present invention greatly reduces the computational load on its data processor by examining only outlier points for identifying vehicles and processing traffic information.

Figure 3:
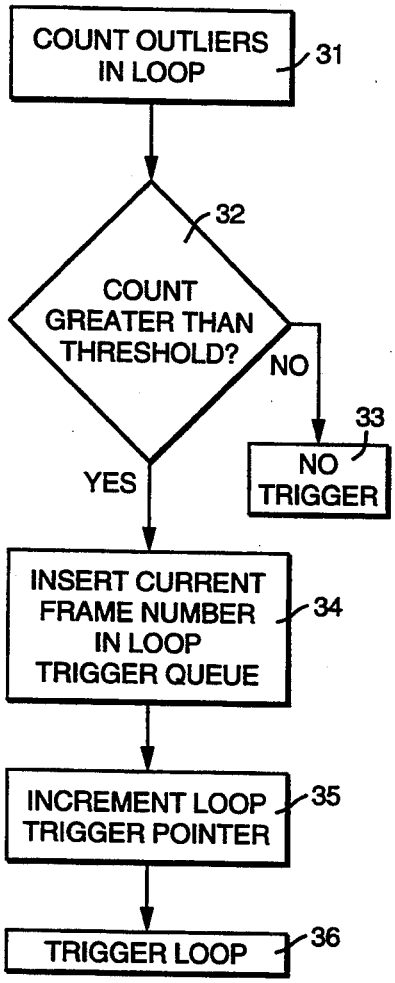
FIG. 3 is a logic flow diagram showing the steps in which a vehicle triggers a video loop by producing outliers detected by a monitoring system of the present invention.

As shown in the logic flow diagram of FIG. 3, vehicle detection by the video loops of the present invention may be accomplished by counting the number of outliers in a loop (i.e., the number of pixels of those being monitored that are identified as outliers by network 20) at step 31. If the number of outliers is less than a predetermined threshold 32, then the video is not triggered at step 33. If the count is greater than the threshold at step 32, then the current video frame number is inserted in a trigger queue for that loop at step 34. A loop trigger pointer is than incremented at step 35, triggering the loop at step 36. System 11 is also capable of monitoring and continually updating the static state of the pixels in a video loop. For example, some pixels within a loop may be detected as outliers due to road surface conditions (such as patches, shadows, etc.) rather than a passing vehicle. Knowledge of the static state allows system 11 to ignore certain outliers and adjust the threshold accordingly, or to assume that a passing vehicle will cause certain outliers to change state so that pixel state transitions can be counted and compared to the threshold. Furthermore, the threshold level can be either static or dynamic (i.e., adjusted over time as a result of changing conditions).

Camera system 11 may be set up and calibrated based on the actual traffic lanes of road 10 or by using several reference points on the ground, such as points P1–P4 shown in FIGS. 1A and B, for example. Using reference points, camera system 11 can be set up and calibrated more easily with various mounting strategies. Microprocessor computations can be made based on the knowledge of the location of the four reference points P1–P4 on the ground (and the distances between them), the location of the corresponding reference points in the sensor image, and the assumption that the area of ground surrounded by the reference points is flat. The actual location of any point within the area bounded by points P1–P4 can be computed based on the corresponding image points. The basic bilinear equations are:

$$x=Ax+By+Cxy+D$$

$$y=Ex+Fy+Gxy+H$$

where (x,y) is a point (in units of pixels) in the image plane and (x,y) is the corresponding point (in units of feet) on road 10. With four corresponding road-to-image reference points P1–P4, there are eight equations with eight unknowns. The unknown coefficients (A–H) can be computed using Gauss-Jordan elimination, and the equations can be used to transform additional points (such as loop locations) from the image to coordinates of road 10. Using the corresponding reference points and the computations described above, video loops 13'–16' can be placed anywhere in the image within the area bounded by points P1–P4, and the corresponding locations and distances on road 10 can be determined.

Setting the range control of camera system 11 determines the sensitivity of the photosensors 12 to incoming light, which determines whether or not an outlier will be identified at a given point in the image. As shown in FIG. 2B, each sensor element 22 may be connected to processor 17 to receive a range control voltage signal ($V_{range}$) on a bus 23. In other embodiments, photosensor array 12 of camera system 11 may be configured to adjust its range control automatically without a signal from processor 17. Under normal operating conditions, the threshold control voltage can be set to a specific value (such as 1.5 volts, for example), and any remaining adjustments to image quality can be accomplished by adjusting the range control voltage ($V_{range}$). As $V_{range}$ is increased (as from 0 to 5 volts, for example), the number of outlier points detected in a static scene increases until a peak is reached, and then the number decreases. In one embodiment, the desired operating voltage for daylight operation of system 11 is just before the peak is reached. A computer algorithm may be used to detect the peak and adjust the range control voltage in lighting conditions ranging from daylight, through twilight, and into darkness. As darkness approaches, the number of outlier points decreases and, therefore, the range control voltage may be increased until no outlier points can be detected at any setting. At about this point, however, motorists normally turn on their lights so that the range control voltage can be lowered as oncoming headlights (or receding taillights) are readily detectable as outlier points.

Another capability of camera system 11 (as opposed to buried inductive loops) is the ability to define video loops of arbitrary shapes and sizes and to assign any number of video loops per lane of road 10. Flexibility in the number and placement of video loops allows system 11 to handle various camera mounting strategies, various road conditions, and various traffic conditions.

Figure 4:
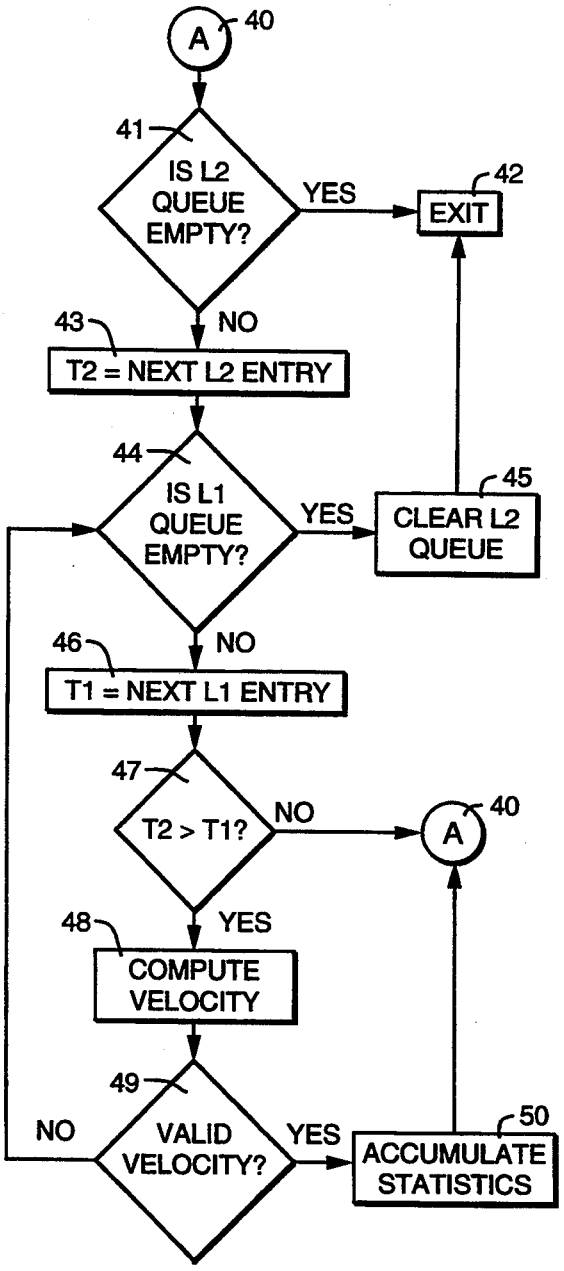
FIG. 4 is a logic flow diagram showing the steps in computing velocity of a vehicle that has triggered two video loops defined by a monitoring system of the present invention.

Vehicle velocity may be computed by monitoring two or more video loops within a lane of road 10 as shown in the logic flow diagram of FIG. 4 (wherein video loop 13' may correspond to first loop L1 and video loop 15' may correspond to second loop L2, for example). When a vehicle passes the first loop L1 in a lane, and thereby triggers the loop at step 44 as described above, system 11 records the video image frame number (i.e., TI) at step 46. When the vehicle triggers the second loop L2 in the lane at step 41, the second video image frame number (i.e., T2) is also recorded at step 43. System 12 converts the difference in frame numbers (i.e., T2−T1) at step 47 to a length of time based on the known camera frame rate. The vehicle's velocity is then computed at step 48 based on the time differential and the distance between the loops as determined from the image calibration procedure described above.

Vehicle velocity computation is initiated at point A, step 40, as illustrated in FIG. 4. If the queue for the second loop L2 is empty at step 41, no vehicle has been detected by loop L2, so the computation routine exits at step 42. If the queue for loop L2 is not empty, the video frame number of the next entry is noted at step 43. Since the video frame rate is known, the frame number T2 for the loop L2 entry corresponds to a time. Next, the queue for the first loop L1 is checked at step 44. If the loop L1 queue is empty, velocity cannot be computed, so the loop L2 queue is cleared at step 45 and the routine is exited. If the loop L1 queue is not empty, the frame number T1 of the next entry is noted at step 46. If the frame number T2 is not greater than the frame number T1 (e.g., the loops were triggered out of sequence), the routine returns to point A, step 40. Otherwise, the difference between frame numbers T2 and T1 is converted to time and vehicle velocity is computed at step 48 based on the known distance between loops L1 and L2. If the velocity is not valid at step 49, the routine returns to step 44 to note the next loop L1 entry. If the velocity is valid at step 49, the statistics am accumulated at step 50, and the routine returns to point A.

As shown in FIG. 4, triggering of the video loops must occur in the logical order for computing velocity. If a vehicle triggers the first loop L1 but not the second loop L2 (or vice versa), a velocity cannot be computed for the vehicle. If a first vehicle triggers the first loop L1 and a second vehicle triggers the second loop L2, however, a potential conflict exists that can only be resolved by validating the computed velocity (i.e., as within a reasonable range) at step 49. This problem can be minimized or eliminated by placing the video loops close together so that they are separated by less than the length of a small car. Another embodiment might use a set of fuzzy logic rules for determining the proper synchronization among the video loop triggers.

Analog Processing

The foregoing description explains how a map of outlier point sources from network 20 is processed to extract information regarding vehicular traffic. In an alternative embodiment of the present invention, the task of counting outlier points in various rows (or video loops) of network 20 can be performed in the analog domain on the photosensor and outlier network chip. For example, the photosensor output can be an analog signal indicating how many outliers are activated in each row of network 20. Such a signal can be scanned sequentially, row-by-row, for example. Using a simple form of analog processing, the signal can be measured against a threshold to yield a binary activation signal for a video loop.

Outlier network 20 can also employ masking to remove selectable areas of an image from the outlier sum. For example, a binary n-task can be scanned onto network 20 (by including an SRAM cell in each pixel, for example) so that stationary objects (e.g. trees) can be screened out and objects in multiple lanes can be distinguished. In a variation of the masking technique, side-by-side regions of the image can have alternative rows masked out such that the masked rows of the first region correspond to the unmasked rows of the second region. This allows both regions to be completely covered by sequential scanning with only a small reduction in position resolution.

Although the present invention has been described with respect to specific embodiments thereof, various changes and modifications can be carried out by those skilled in the art without departing from the scope of the invention. Therefore, it is intended that the present invention encompass such changes and modifications as fall within the scope of the appended claims.

We claim:

1. A method of monitoring vehicular traffic, comprising the steps of:

providing a photosensor array for generating an image of a vehicle roadway;

designating an area of said image corresponding to a selected region of said roadway;

connecting a nonlinear resistive network to said photosensor array for detecting outlier points in said image;

generating a map of said outlier points in said image; and determining the presence of a vehicle in said region of said roadway by identifying outlier points in said designated area of said image.

2. The method of claim 1, further comprising the step of designating a plurality of areas of said image corresponding to selected regions of said roadway.

3. The method of claim 2, further comprising the step of determining velocity of said vehicle by measuring time for said identified outlier points to be detected in successive areas of said image corresponding to said selected regions of said roadway.

4. The method of claim 1, wherein the step of determining the presence of a vehicle includes the step of connecting a computer processor to said nonlinear resistive network for analyzing said outlier points.

5. The method of claim 1, wherein the step of designating an area of said image corresponding to a selected region of said roadway includes the step of calibrating said photosensor image with reference points of said selected region of said roadway.

6. The method of claim 1, wherein the step of generating an image includes the step of adjusting a range control voltage of said photosensor array in response to changing lighting conditions on said roadway.

7. A method of monitoring vehicular traffic, comprising the steps of:

providing a photosensor array for generating an image of a vehicle roadway;

designating areas of said image corresponding to selected regions of said roadway;

connecting a nonlinear resistive network to said photosensor array for detecting outlier points in said image:

generating a map of said outlier points in said image;

identifying outlier points in said designated areas of said image; and determining the presence of vehicles in said regions of said roadway by analyzing said outlier points in said designated areas of said image.

8. The method of claim 7, further comprising the step of determining velocity of said vehicle by measuring time for said identified outlier points to be detected in successive areas of said image corresponding to said selected regions of said roadway.

9. The method of claim 7, wherein the step of determining the presence of a vehicle includes the step of connecting a computer processor to said nonlinear resistive network for analyzing said outlier points.

10. The method of claim 9, wherein the step of designating an area of said image corresponding to a selected region of said roadway includes the step of calibrating said photosensor image with reference points of said selected region of said roadway.

11. The method of claim 10, wherein the step of generating an image includes the step of adjusting a range control voltage of said photosensor array in response to changing lighting conditions on said roadway.

12. A system for monitoring vehicular traffic, comprising:

a photosensor array for generating an image of a vehicle roadway;

a nonlinear resistive network connected to said photosensor array for generating a map of outlier points in said image;

video loops comprising designated areas of said network corresponding to selected regions of said roadway;

means for identifying outlier points in said video loops; and means for determining the presence of vehicles in said selected regions of said roadway by analyzing said outlier points in said video loops.

13. The system of claim 12, further comprising means for determining velocity of said vehicle by measuring time for said identified outlier points to be detected in successive video loops corresponding to said selected regions of said roadway.

14. The system of claim 12, further comprising a computer processor connected to said nonlinear resistive network for analyzing said outlier points.

15. The system of claim 14, further comprising means for calibrating said photosensor image with reference points of said selected region of said roadway.

16. The system of claim 14, further comprising means for adjusting a range control voltage of said photosensor array in response to changing lighting conditions on said roadway.

* * * * *